US006422420B1

(12) United States Patent
Brown

(10) Patent No.: US 6,422,420 B1
(45) Date of Patent: Jul. 23, 2002

(54) COMPRESSED GAS SAFETY INFLATOR FOR LIFE VESTS, LIFE RAFTS AND THE LIKE

(76) Inventor: Dennis Brown, P.O. Box 151, Mantoloking, NJ (US) 08751

( * ) Notice: Subject to any disclaimer, the term of this patent is extended or adjusted under 35 U.S.C. 154(b) by 0 days.

(21) Appl. No.: 09/854,596

(22) Filed: May 15, 2001

(51) Int. Cl.[7] ..... B67D 5/00

(52) U.S. Cl. ..... 222/5; 441/93; 441/94; 115/277; 115/309; 137/68; 222/48

(58) Field of Search ..... 441/93–95; 222/3, 222/5, 48, 80, 81, 83, 83.5; 137/68.18, 553, 556; 141/330, 329; 116/277, 280, 284, 285, 303, 307, 309

(56) References Cited

U.S. PATENT DOCUMENTS 4,498,605 A * 2/1985 Mackal et al. ..... 222/5
5,271,525 A * 12/1993 Petrie ..... 222/5
5,333,656 A * 8/1994 Mackal ..... 141/19
5,643,030 A * 7/1997 Brown ..... 116/277
5,852,986 A * 12/1998 Mackal ..... 116/266

* cited by examiner

*Primary Examiner*—William C. Doerrler
*Assistant Examiner*—Stephen Willatt
(74) *Attorney, Agent, or Firm*—Charles I. Brodsky

(57) ABSTRACT

A gas cartridge introduced into the housing of the invention is punctured by a pin moved by an arm designed to show through a series of windows whether the cartridge is full or empty. A pulling on a tab rotates the arm to action, in puncturing the cartridge and a spring then locks the visual displays in position. The pin is provided with a cone-shaped head which prevents any re-arming of the arm from changing the display to show that the cartridge is full, when in fact the cartridge has been spent. The amount of pull needed to activate the arm can be selectively controlled.

20 Claims, 8 Drawing Sheets

COMPRESSED GAS SAFETY INFLATOR FOR LIFE VESTS, LIFE RAFTS AND THE LIKE

CROSS-REFERENCE TO RELATED APPLICATIONS

NONE

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

NOT APPLICABLE

BACKGROUND OF THE INVENTION

1. Field of the Invention

This invention relates to the marine inflatable device industry and, more particularly, to apparatus for inflating life preservers, vests, rafts, or similar such devices in accordance with Coast Guard and Airline rules and/or regulations.

2. Description of the Related Art

Small cartridges which hold large quantities of carbon dioxide or other gas under compression for inflating these types of devices are known. Typical are those described in the Mackal U.S. Pat. Nos. 3,809,288; 4,223,805; 4,267,944; 4,498,605; 5,058,635; and 5,333,656. As this last patent pointed out, one problem in the industry followed from the fact that a person could not quickly determine whether the cartridge attached to the inflator was spent. Since a discharged cartridge was virtually identical in outward appearance to a fully charged one, the possibility existed that the cartridge in place was empty, and not filled. As the patent noted, the only way to resolve the question was to unscrew the cartridge, and visually inspect its membrane to see whether it had been already punctured.

U.S. Pat. No. 5,333,656 addressed the problem by painting a red sign on an inflator arm, to appear in a window when the arm was in the discharge position of the inflator, to indicate that the cartridge was empty. Although the theory was that the red sign would disappear only after a full cartridge was replaced back into position, testing revealed that the red sign on the inflator arm was moved out of the viewing area no matter the condition of the replacement cartridge being reinserted. Investigation revealed that this followed from the irregular type hole the patent's chisel-shaped pin produced when puncturing the cartridge to release its compressed gas when filling the inflatable device. The intent of the invention—to show that an empty cartridge was in place—was thus not reliably achieved.

Further testing showed that this problem persisted even with the modified puncture pin described in Mackal's earlier U.S. Pat. No. 5,058,635. There, it was found that its chisel-shaped head often caused the puncture hole rim to snag on the pin, and because the arrangement also included an internal spring. that was biased in a direction to exert a backward pull on the puncture pin. Such biasing was noted to sometimes snag (and lodge) on its way into the charged cartridge during its detonation—which interfered with the desired venting and inflation.

These puncture pin problems were overcome, however, with the safety inflator described in my own U.S. Pat. No. 5,643,030, in which the pin was provided with a cone-shaped head. With it, a perfectly round hole was created upon puncture in the cap of the gas cartridge. This puncture pin possessed a barely perceptible flat head, enabling it to bear against the cap without prematurely puncturing it, as if the head were pointed instead. With the cone-shaped configuration, the accidental insertion of a spent cartridge was automatically prevented from changing the display to improperly indicate the cartridge to be full when, in fact, it were empty.

SUMMARY OF THE INVENTION

As will become clear from the following description, the inflator of the present invention retains this cone-shaped, cross-section puncture pin, although somewhat modified, to prevent any cartridge replacement from wrongly changing a display of readiness. As will also become clear, the inflator of the invention goes one step further, in offering a construction which makes it easier to observe the cartridge condition than with my U.S. Pat. No. 5,643,030 design, and one which is more compact for use. In one version, a snap-action lever arm is employed to allow controlled detonation at even low pull tensions. In a second version, an internal signalling flag is removed to significantly reduce the size and weight of the inflator.

BRIEF DESCRIPTION OF THE DRAWINGS

These and other features of the invention will be more clearly understood from a consideration of the following description, taken in connection with the accompanying drawings, in which.

DETAILED DESCRIPTION OF THE INVENTION

Figure 1:
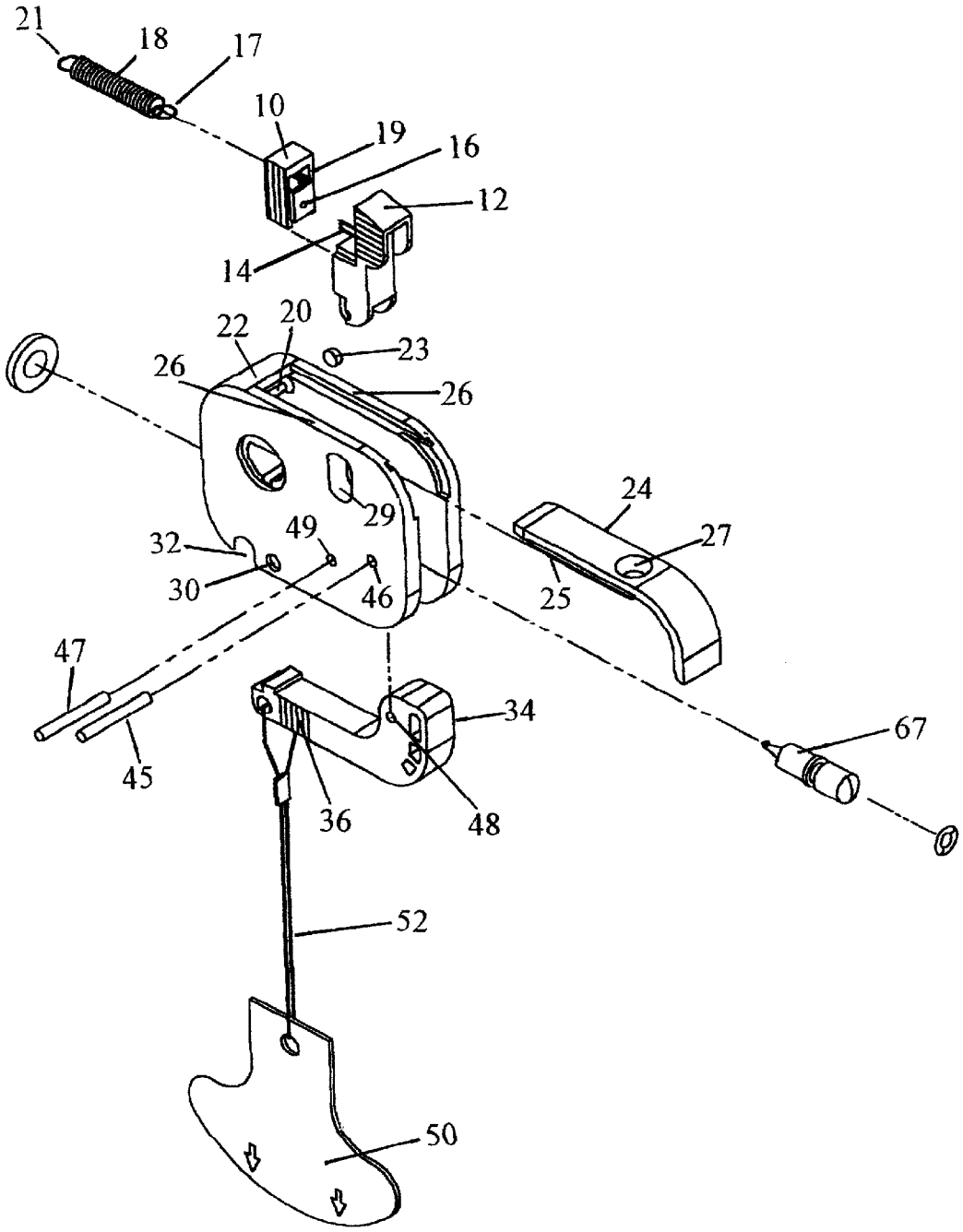
FIG. 1 is a disassembled view of a compressed gas safety inflator for life vests, life rafts and the like according to the invention.
Figure 3:
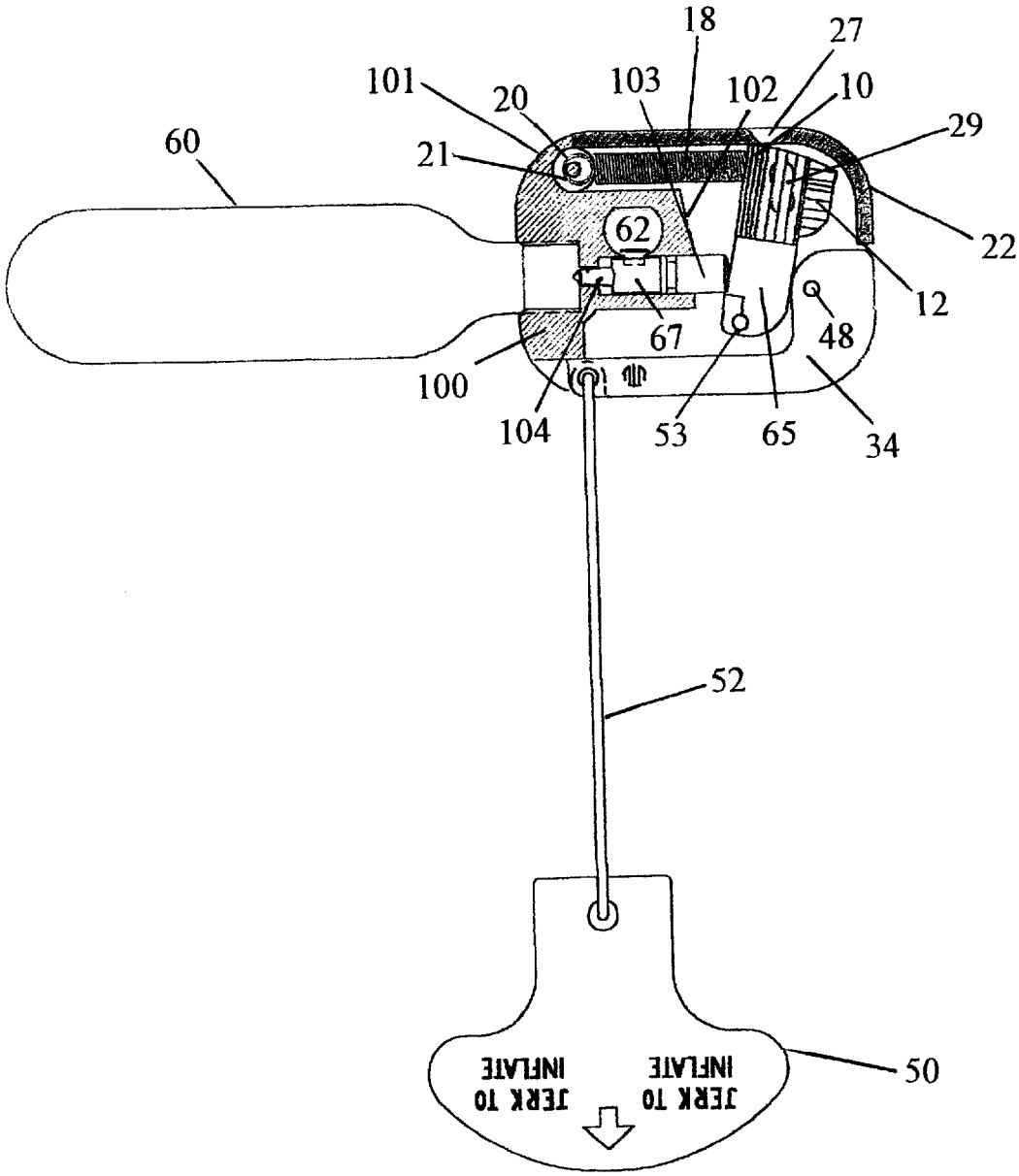
FIGS. 3 and 4 are internal views of the compressed gas safety inflator for the "armed" and "discharged" conditions, respectively.
Figure 4:
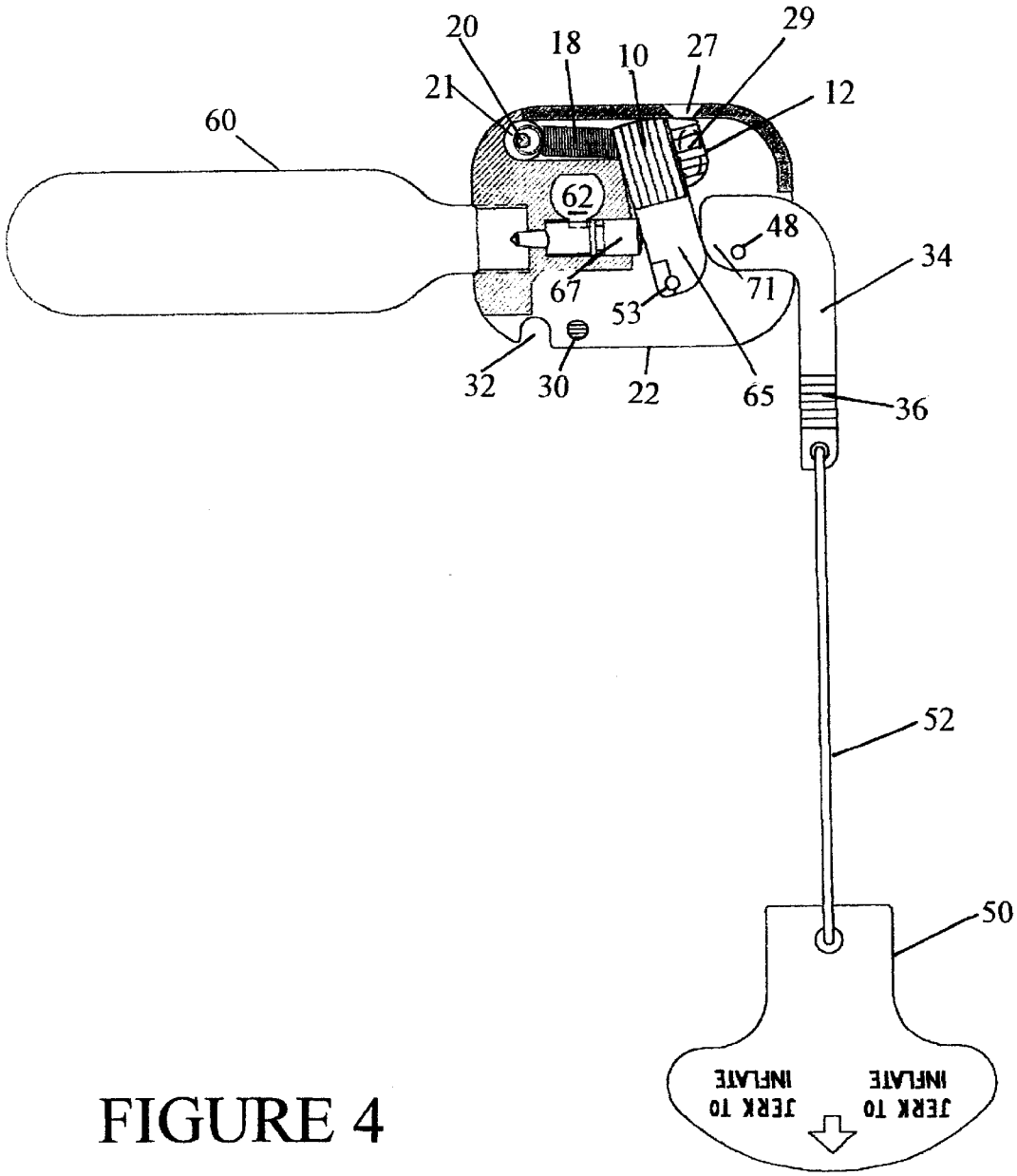

FIGS. 1 and 3–4 illustrate several improvements and modifications to the safety inflator indicator flag described in my afore-noted patent. There, the indicator flag was colored "green" and "red"—whereas, here, the flag consists of two plastic parts 10 and 12, the one 10 being permanent green plastic and the other 12 being permanent red plastic to insure that the green and red colors remain distinctly separated on the flag. With the color "green" being shown in the drawings by "vertical lines", and with the color "red" being shown by "horizontal lines", this further insures that the colors will not fade or wear over time, and that the ratios of the coloration for each flag will be exactly the same. By otherwise painting or hot-stamping the colors onto the flag, a risk results that the colors might run together or be otherwise incorrectly applied in a manner to throw-off the correct red/green color ratio.

Both plastic parts are hollow, with the red plastic part 12 having a pin 14 to seat within a hole 16 on the green plastic part 10 for a secure, permanent fit to anchor the parts 10, 12 together. One end 17 of a spring 18 is inserted into the hollow opening of the green plastic part 10 to attach to a hook 19, while a second opposite end 21 loops around a pin 20 in the inflator body 22 (FIGS. 3, 4). This attachment of the spring 18 to the part 10 and to the pin 20 expedites the assembly of the inflator. Such pin 20 may also be of plastic, and automatically molded into the inflator body 22 to save the cost of an extra steel pin in securing the spring 18 in place. The injection mold cam employed to produce the plastic pin 20 leaves a hole in the side of the inflator body 22, which is covered with a small, circular plug 23. (As will be appreciated, the "hollowing-out" of the green/red plastic parts by "coring" is a common occurrence in an injection molding process; this allows the entire flag to be manufactured faster as it reduces the cycle time for molten plastic material to be injected into the mold, and offers the further feature of the finished flag being significantly lighter for use in those instances where weight considerations are important—for example, when employing the compressed gas safety inflator of the invention for use in an airline vest where "weight" is an important factor in determining jetliner fuel consumption costs.)

Whereas the cover for the safety inflator of my U.S. Pat. No. 5,643,030 was secured by metal screws, the cover 24 employed here is devoid of any screws, but is allowed to slide via raised tongue ridges on opposite sides 25 into a pair of grooves 26. Once in place, the cover 24 then snugly fits with the body 22 so as not to be dislodged upon falling. A signalling window having a bevelled side is cut into the top of the cover 24 at 27, and a pair of similar signalling windows 29 are cut on opposite sides of the inflator body 22, also with bevelled sides. The three windows offer easy, wide viewing of the flag color in alignment therewith.

A pair of signalling windows 30 are additionally included, one on each side of the inflator body 22 adjacent to a body slot 32 for the inflator arm 34. Two small pieces of green plastic snap onto each side of the inflator arm 34 at 36, to be seen only through the window 30 when the inflator arm 34 is closed and a fully charged compressed gas cartridge is in place.

Figures 5A, 5B:
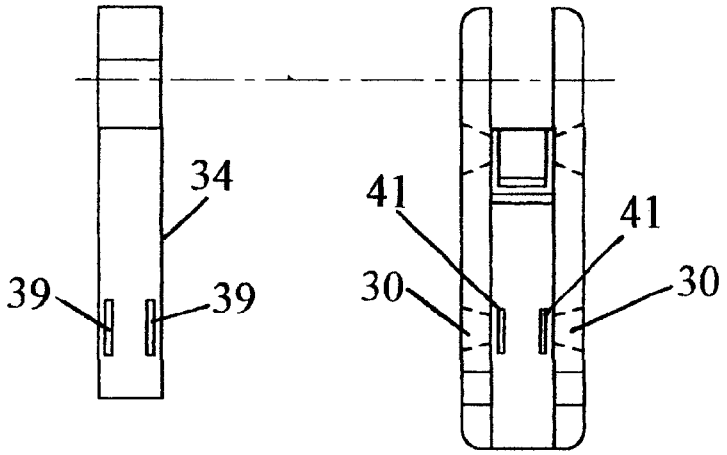
FIGS. 5A and 5B are top and bottom views, respectively, of the inflator arm of the invention and of the inflator body, helpful in an understanding of the invention.

As previously noted, FIG. 5A is a top view of the inflator arm 34 while FIG. 5B is a bottom view of the inflator body 22. A pair of small, red plastic tabs snap into place within two slots 39 of the arm 34 to signal through the windows 30 when the inflator arm 34 is jerked downward and the compressed gas cartridge is discharged. When the inflator arm 34 is in the closed position, on the other hand, the two red tabs enter the two slots 39 in the inflator arm and become concealed. Such red tabs are shown at 41 in FIG. 5B, adjacent the windows 30.

A first pin 45 passes through an aperture 46 in the body 22 to align with an aperture 48 in the inflator arm 34 to hold it in position and serve as a pivot point. A pull-tab 50 couples to a lanyard 52 for rotating the inflator arm 34 in a counterclockwise direction when jerking downwardly on the tab 50. In so doing, the inflator arm 34 rotates about the pin 45 in apertures 46 and 48.

Figure 2B:
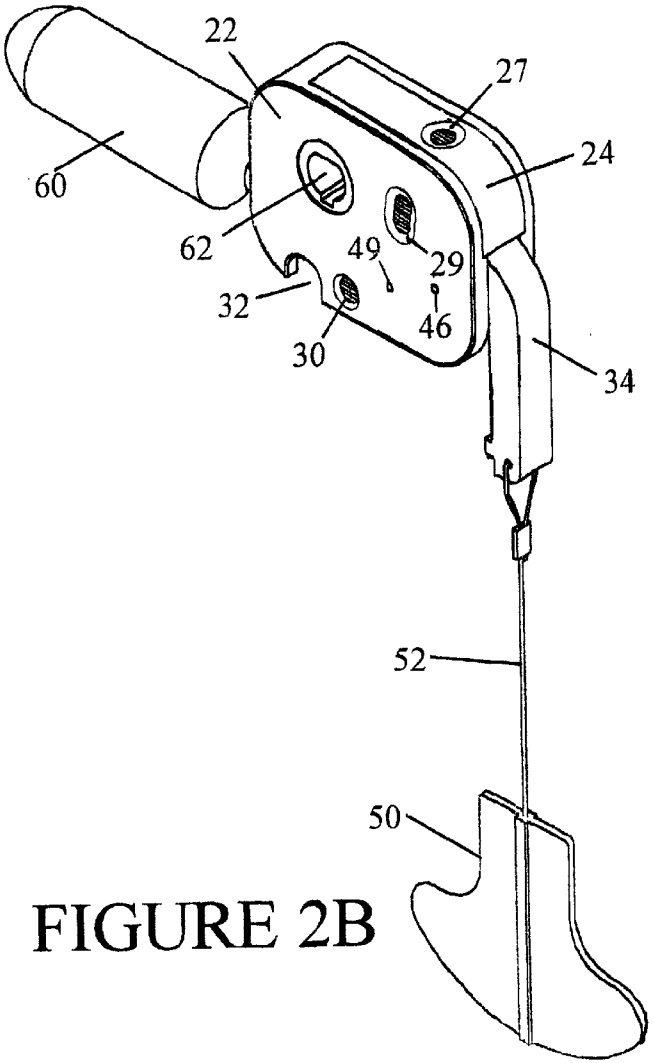
FIGS. 2A and 2B are perspective views of the compressed gas safety inflator in assembled form for the "armed" and "discharged" conditions of the inflator, respectively.
Figure 2A:
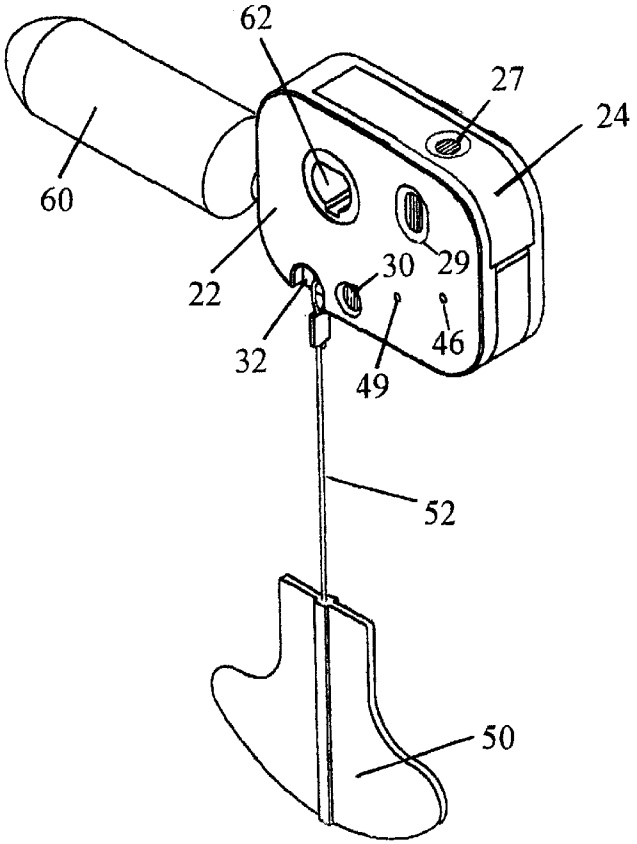

FIGS. 2A and 2B show the external views of the compressed gas safety inflator for the "armed" and "discharged" conditions of the inflator, before and after the tab 50 is jerked downwardly. The gas cartridge is shown at 60, with the manifold hole for filling the inflatable life preserver, vest, raft, etc. being shown at 62.

FIG. 3 is an internal view of the safety inflator of the invention in its armed position with a fully charged compressed gas cartridge 60 in place. With the green and red signalling parts, or flags 10, 12 pinned together as described, and inserted over the flag arm or lever 65, the signalling feature of the safety inflator is activated when the compressed gas cartridge is inserted. Such action forces the detonator or puncture pin 67 rearwardly against the arm 65 (i.e. to the right), which pivots the arm 65 against the action of the spring 18 about a second pin 47 passing through a second aperture 49 in the body 22 in alignment with an aperture 53 in the arm 65. This action-continues to force the arm 65 in a clockwise direction until it contacts a cam surface 71 of the inflator arm 34 until it reaches its closed position which exactly corresponds to the cartridge being fully screwed into its threaded well. In such position, the green plastic part 10 shows through the window 27 of the cover 24 and through the windows 29 on each side of the body (i.e., the "vertical lines" in FIG. 3).

With the tab 50 jerked downwardly to actuate the inflator, the view of FIG. 4 results, in which the cam surface 71 of the inflator arm 34 bears against the lever arm 65 to rotate it in a counterclockwise direction about the pin 47 in aperture 53, compressing the spring 18 until the puncture pin 67 pierces the compressed cartridge cap, detonating the cartridge 60, and venting its contained gas into the life vest or other inflatable device via the manifold 62. In such position, the red plastic part 12 then becomes visible through the signalling windows 27 and 29 (i.e., the "horizontal lines" in FIG. 4). As will be appreciated by those skilled in the art, the green notation through the windows 30 is likewise switched to the red notation when the tab 50 and the inflator arm 34 are thus yanked downwardly.

(In this respect, FIG. 3 shows the body or housing 22 that includes a chamber 100, in part defined by internal front and rear housing walls 101, 102 respectively. Within the chamber 100 is the puncture pin 67, with its barrel end 103 extending through the rear wall 102 and with its cone-shaped cross-section head end 104 extending towards the front wall 101. As will be seen, screwing in the cartridge 60 forces its cap to bear against the head end 104 of the puncture pin 67.)

Figure 6:
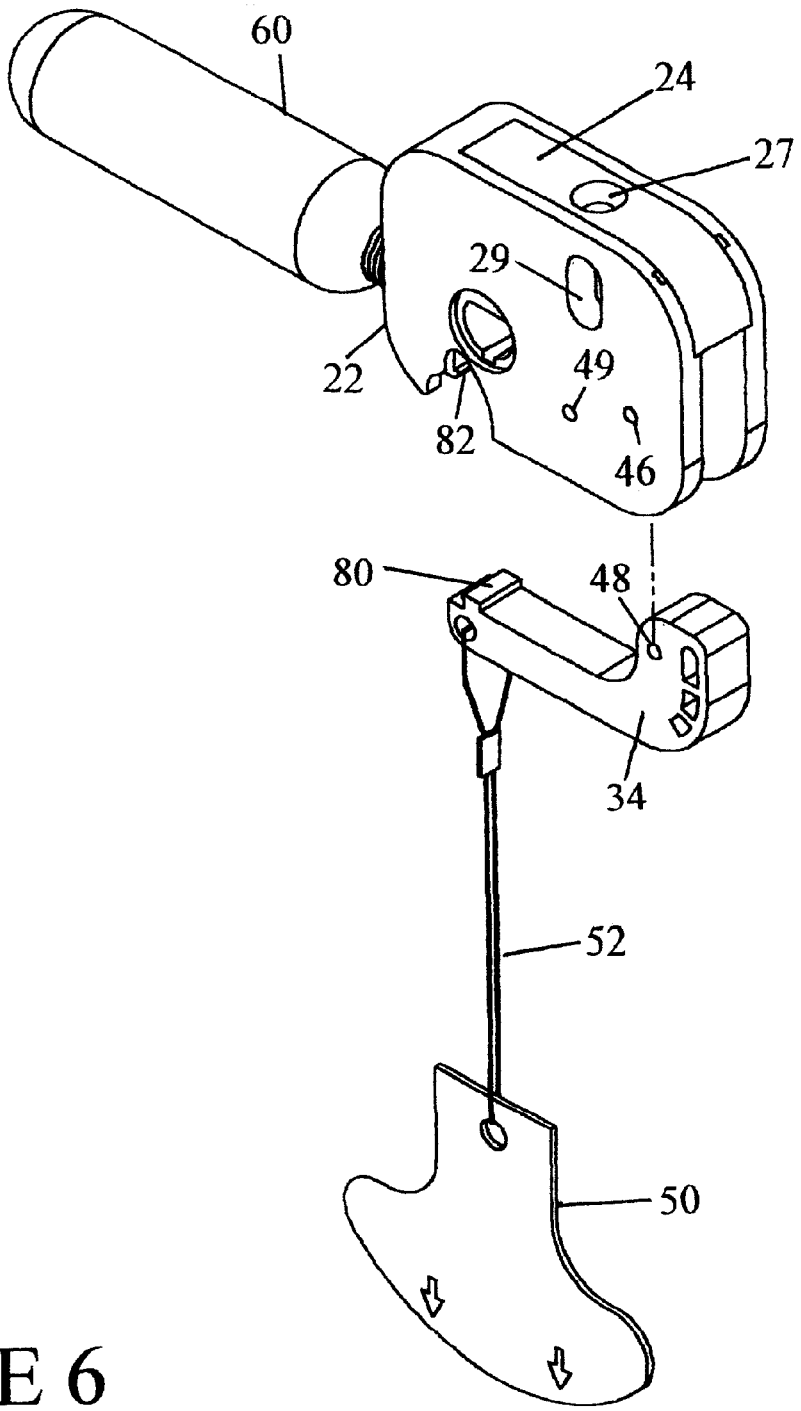
FIG. 6 is a view of the partially assembled, partially disassembled compressed gas safety inflator of the invention, employing the snap-action feature for detonation at even low pull tensions.

The embodiment of the invention shown in FIG. 6, on the other hand, is quite useful in detonating the compressed gas cartridge with minimal pressure pull when jerking downwardly on the tab actuator 50. This is particularly attractive in instances within the province of the United States Coast Guard—whose regulations presently require that a compressed carbon dioxide cartridge, for example, discharge at an inflator arm pull pressure of no less than 5 pounds, and no more than 15 pounds. Because of variations in the internal assembly manufacture of inflators presently on the market (and because of variations in the manufacture and operation of their enclosed compressed gas cartridges), many violations have been noted to occur where detonation has taken upwards of 25–30 pounds to discharge. With the embodiment of the invention shown in FIG. 6, these problems are overcome, and through the use of a small, elevated ridge molded into the inflator arm 34 which allows the arm to firmly snap over a small plastic lip located in the body of the safety inflator, between the middle of the lanyard holes located on each underside of the body.

Such ridge is shown in FIG. 6 as 80 with the plastic lip in the inflator body 22 being shown at 81. By adjusting the thickness of the elevated ridge 80 (measured from left-to-right in the drawing) the inflator arm 34 will automatically pull free from the inflator body 22 at any predetermined tension selected. By making the ridge 80 slightly thicker, the inflator arm 34 will firmly snap into the inflator body 22, and consistently release at a pull force of approximately 15 pounds. By making the elevated ridge 80 slightly thinner, the inflator arm 34 would release from the body 22 at a lesser pull force, for example, at about 5 pounds.

As will be understood, when this arm snap-fit feature of FIG. 6 is included, the two signalling windows 30 of the inflator body 22 must be removed since the signalling feature of the inflator relies first, on closing the inflator arm 34 by snapping it shut, and second, by screwing in the fully charged compressed gas cartridge 60. This is to be contrasted with the signalling actions described with respect to the constructions of FIGS. 3 and 4—which rely on screwing in the fully charged compressed gas cartridge 60 first—which, in turn, moves the detonating pin 67, the flag and the inflating arm cam until the inflator arm 34 closes.

Figure 7:
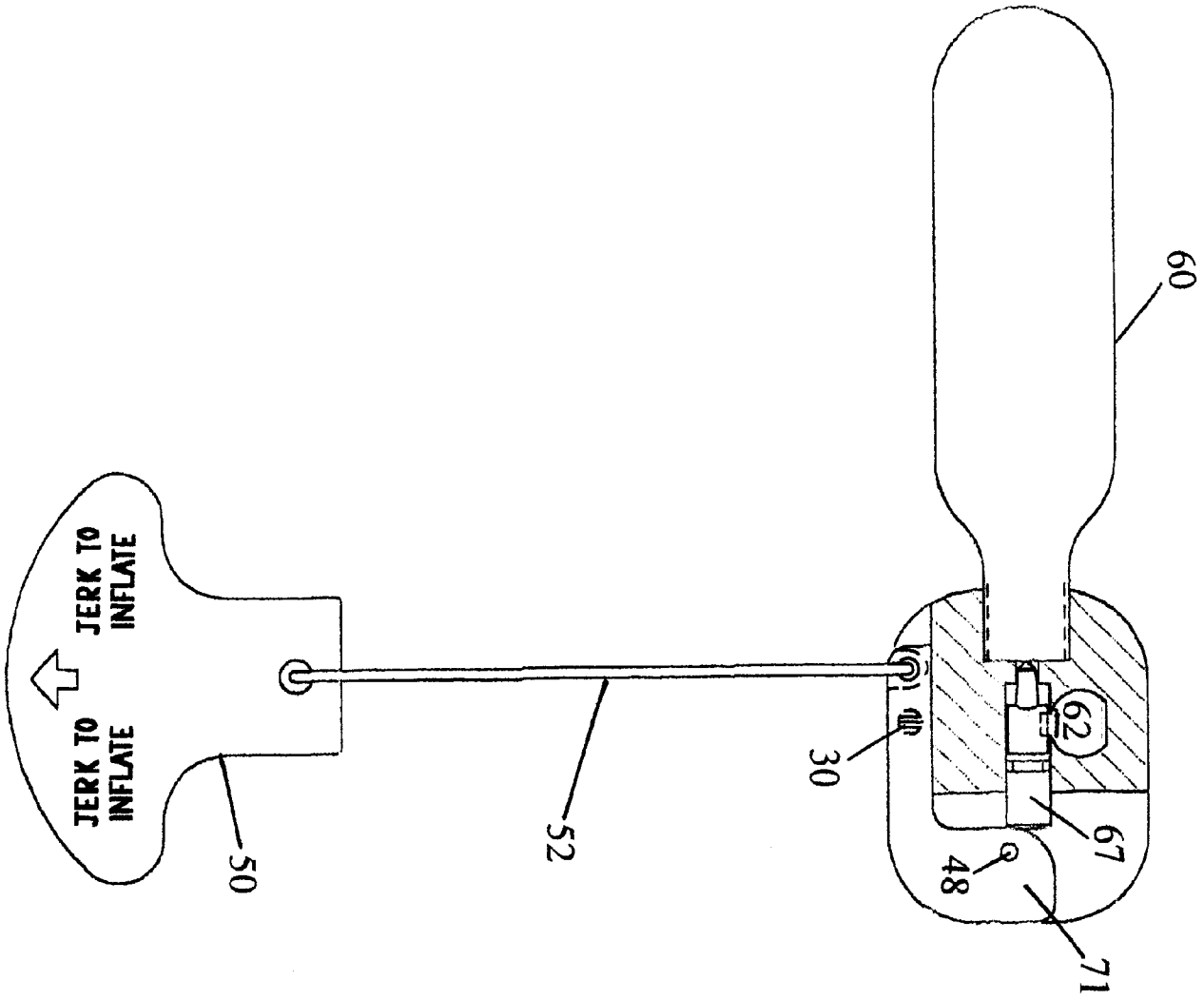
FIG. 7 is an internal view of an embodiment of the compressed gas safety inflator in which the "cartridge display readiness flag" has been removed.

The embodiment of the invention shown in FIG. 7, on the other hand, is one which is desirable in those instances where weight is a critical consideration, as with airline life vests, in attempting to keep down fuel costs. In particular, this embodiment is one in which the green and red plastic parts 10, 12 are removed, as well as the signalling windows 27 and 29. In this mini-version of the inflator, only the signalling windows 30 are retained, one on each side of the inflator arm 34 as shown in FIG. 1.

In the operation of the safety inflator of FIG. 7, when a fully charged compressed gas cartridge with an intact cap is screwed into the inflator, the cap forces back the puncture pin 67, which forces the cam 71 on the arm 34 to rotate clockwise in a manner to close into the inflator body itself. Once the cartridge is snugly screwed into place, the green plastic pieces at 36 on each side of the arm 34 then show through the two windows 30, signalling that the inflator is armed. If, on the other hand, a discharged cartridge with a hole in the cartridge cap is screwed into the inflator, the detonator pin 67 will penetrate into the hole—but neither the detonator pin nor the inflator arm cam will move. As a consequence, the inflator arm 34 will not close, and its red signals will remain in the two lower windows 30, thereby signalling that a fully charged gas cartridge must still be reinserted into the inflator.

Figure 8:
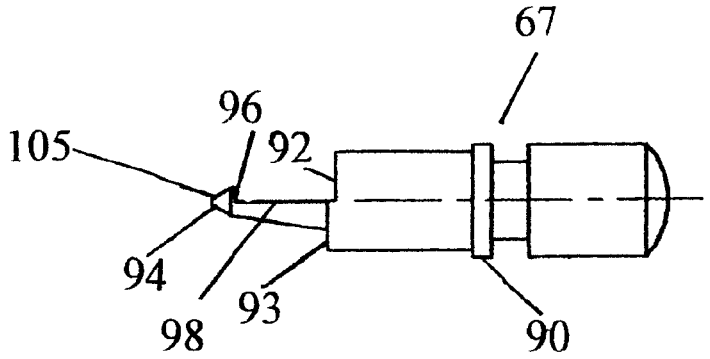
FIG. 8 shows a puncture pin constructed in accordance with the invention to detonate a gas cartridge of the types illustrated in FIGS. 1–4 and 6–7, modified somewhat from the puncture pin of my U.S. Pat. No. 5,643,030 patent.

FIG. 8 shows a modified detonating puncture pin inflator to that shown in my U.S. Pat. No. 5,643,030. While still having a barely perceptible flat tip, this detonator pin 67 has the sides of the pin taper at a much sharper angle. This allows the cone shaped pin head to more easily penetrate the charged cartridge cap. This is so even for the situation where the cone shaped pin head includes a slightly rounded tip with a collar behind it.

One further improvement in the pin 67 follows from the possible tendency for the puncture pin of my earlier patent to slide too far forward when the inflator arm is pulled downwardly—which might sometimes cause the pin head to enter the cartridge and snag against the rim of the cartridge cap hole. By widening and extending the length of the pin into a round barrel directly in front of the "O" ring wall, the top of the barrel forms an upper step which comes into direct contact with the retaining wall that forms the bottom of the threaded hole in which the cartridge is screwed. This stops the pin from advancing too far into the cartridge once the inflator is activated. Since the lower step of the barrel does not quite reach the retaining wall, when the compressed gas passes down through the vent notch, the open space directly in front of the lower barrel step allows the gas to vent over this lower step directly into the life vest or other inflatable device. As with my earlier patent, the compressed gas may typically be carbon dioxide.

In FIG. 8, the "O" ring is shown at 90, the lower step is shown at 92, the upper step is shown at 93, the collar behind the cone shaped head 94 is shown at 96, the vent notch is shown at 98, and the flat or slightly rounded pin tip is shown at 105.

While there have been described what are considered to be preferred embodiments of the present invention, it will be readily appreciated by those skilled in the art that modifications can be made without departing from the scope of the teachings herein. For at least such reason, therefore, resort should be had to the claims appended hereto for a true understanding of the scope of the invention.

I claim:

1. Apparatus adapted to receive a puncture a gas cartridge for the filling of an inflatable device, comprising:

a first arm having a cam surface at one end thereof, a lanyard secured at a second end thereof, and a tab coupled to said lanyard for rotating said arm when pulled;

a second arm having a shaft pproximate to said cam surface, a head at one end thereof divided into first and second visually distinct sections, and a pin at a second end thereof about which said shaft is actuable to rotate;

a housing including front and rear surfaces joined at a first side edge thereof, joined at spaced-apart top edges by a cover, and joined at spaced-apart bottom edges by said second arm when rotated to a quiescent position, said housing then enclosing said first and second arms;

a spring secured at a first end within said housing, and a second end to said second arm;

a chamber within said housing defined by front and rear internal walls;

a window in said housing for viewing said first and second visually distinct sections of said head of said second arm;

an inflation pin within said chamber, quiescently positioned to extend beyond said rear internal wall, and movable in direction towards and through said front internal wall, and towards and through said rear internal wall;

with said pin having a head end of cone-shaped cross-section to bear against a gas cartridge introduced into said housing, a barrel end with upper and lower steps to bear against said shaft of said second arm, and a body including a vent means;

wherein said first visually distinct section is viewable through said window prior to said tab being pulled, and wherein said second visually distinct section is viewable through said window after said tab is pulled;

and wherein said pin forms a round hole in a cap of said cartridge when brought against said cartridge to bear against said cap upon pulling of said tab.

2. The apparatus of claim 1 wherein said spring is compressed to a locked position after said tab is pulled, and in a uncompressed, released position prior to said tab being pulled.

3. The apparatus of claim 1 wherein said window is situated on at least one of said front and rear surfaces of said housing.

4. The apparatus of claim 1 wherein said window is situated on said cover of said housing.

5. The apparatus of claim 3 wherein there is additionally included a further window on said cover of said housing for viewing said head on said second arm.

6. The apparatus of claim 3 including a third visually distinct section on said first arm and a further window on at least one of said front and rear surfaces of said housing for viewing said visually distinct section of said first arm.

7. The apparatus of claim 6 wherein there is additionally included a further window on said cover of said housing for viewing said head on said second arm.

8. The apparatus of claim 1 wherein said first visually distinct section is colored "GREEN" and wherein said second visually distinct section is colored "RED".

9. The apparatus of claim 1 wherein said first and second visually distinct sections are composed of separately manufactured parts joined together.

10. The apparatus of claim 1 wherein there is additionally included in said housing, a manifold exhaust for coupling said housing to an inflatable device to be filled with gas from said cartridge.

11. The apparatus of claim 1 wherein said barrel end of said pin is positioned to bear against said shaft of said second arm at a point nearer to said pin on said second arm than to said head on said second arm.

12. The apparatus of claim 11 wherein said cam surface of said first arm is positioned proximate to said shaft of said second arm at a position nearer to said head of said second arm than to said pin on said second arm.

13. The apparatus of claim 1 wherein said barrel end of said pin quiescently extends beyond said rear internal wall of said housing, and beyond the location of said pin on said second arm.

14. The apparatus of claim 1 wherein said vent means comprises a channel extending along the entire exterior length of said body of said pin.

15. The apparatus of claim 1 wherein said inflation pin is of hollow configuration and wherein said vent means comprises a hole along said body of said pin.

16. Apparatus adapted to receive and puncture a gas cartridge for the filling of an inflatable device, comprising:

a first arm having a cam surface at one end thereof, a said lanyard for rotating said arm when pulled;

a second arm having a shaft proximate to said cam surface, a head at one end thereof divided into first and second visually distinct sections, and a pin at a second end thereof about which said shaft is actuable to rotate;

a housing enclosing said first and second arms, and including a chamber defined by front and rear internal walls;

a spring secured at a first end within said housing, and at a second end to said second arm;

at least one window in said housing for viewing said first and second visually distinct sections of said head of said second arm;

an inflation pin within said chamber, quiescently positioned to extend beyond said rear internal wall, and movable in direction towards and through said front internal wall, and towards and through said rear internal wall;

with said pin having a head end of cone-shaped cross-section to bear against a gas cartridge introduced into said housing, a barrel end with upper and lower steps to bear against said shaft of said second arm, and a body including a vent means;

wherein said first visually distinct section is viewable through said window prior to said tab being pulled, and wherein said second visually distinct section is viewable through said window after said tab is pulled;

and wherein said pin forms a round hole in a cap of said cartridge when brought against said cartridge to bear against said cap upon pulling of said tab.

17. The apparatus of claim 16 wherein said body of said pin is of a circular cross-section, tapered along its length and wherein said vent means includes a vent hole.

18. The apparatus of claim 17 wherein said cone-shaped head of said pin includes a flat tip bearing against said introduced gas cartridge.

19. The apparatus of claim 16, wherein said first arm includes an elevated ridge of predetermined thickness fitted within said housing in controlling pull pressure on said lanyard to rotate said first arm.

20. The apparatus of claim 19 wherein an elevated ridge of greater thickness increases the pull pressure needed to rotate said first arm wherein a lesser thickness decreases the pull pressure needed for rotation.

* * * * *